US006651574B1

(12) United States Patent
Ellens et al.

(10) Patent No.: US 6,651,574 B1
(45) Date of Patent: Nov. 25, 2003

(54) SPOOL VALVE

(75) Inventors: Mark William Ellens, Vancouver (CA); Jan Kuyper, Gibsons (CA); Neal Wesley Denis Wood, Burnaby (CA); Steven Michael Winiski, Vancouver (CA); Randall Theodore Mark, Vancouver (CA)

(73) Assignee: Teleflex Canada Limited Partnership, Richmond (CA)

( * ) Notice: Subject to any disclaimer, the term of this patent is extended or adjusted under 35 U.S.C. 154(b) by 0 days.

(21) Appl. No.: 10/042,272

(22) Filed: Jan. 11, 2002

(51) Int. Cl.[7] ..... B63H 25/22
(52) U.S. Cl. ..... 114/150; 440/61
(58) Field of Search ..... 114/150; 440/61; 60/470; 137/624.34

(56) References Cited

U.S. PATENT DOCUMENTS

| | | | | |
|---|---|---|---|---|
| 3,009,480 A | | 11/1961 | Miller | |
| 3,472,281 A | | 10/1969 | Chiba et al. | |
| 3,477,344 A | | 11/1969 | Fisher | |
| 3,988,966 A | * | 11/1976 | Leonard | 137/625.63 |
| 4,595,370 A | * | 6/1986 | Small | 114/150 |
| 4,889,034 A | * | 12/1989 | Husted | 91/218 |
| 5,404,961 A | | 4/1995 | Huber | |
| 6,318,400 B1 | | 11/2001 | Hope et al. | |

FOREIGN PATENT DOCUMENTS

| | | |
|---|---|---|
| FR | 998527 | 1/1952 |
| GB | 730856 | 6/1955 |

* cited by examiner

*Primary Examiner*—Sherman Basinger
(74) *Attorney, Agent, or Firm*—Norman M. Cameron

(57) ABSTRACT

A valve includes a housing with an elongated bore having a longitudinal axis and a spool reciprocatingly mounted within the bore for relative movement along the bore parallel to the axis. The housing has a housing passageway and the spool has a spool passageway. The passageways align in at least one axial position of the spool along the bore, whereby fluids can pass between the spool and the housing. The passageway of one of the spool or the housing includes a first groove which extends parallel to the axis, but not substantially about said one of the spool or the housing. The passageway of another of the spool or the housing includes a second groove which extends circumferentially about said another of the spool or the housing.

20 Claims, 7 Drawing Sheets

SPOOL VALVE

BACKGROUND OF THE INVENTION

This invention relates to spool valves and, in particular, to spool valves for marine stern drives.

Spool valves conventionally include an outer member or housing having a longitudinal bore extending therethrough. A spool is reciprocatingly received in the bore. The interior of the bore has one or more circumferential grooves, while the exterior of the spool also has one are more circumferential grooves. The grooves in the spool are aligned with the grooves in the bore of the outer member, or are nonaligned with the grooves in the outer member, depending upon the axial position of the spool relative to the bore.

When one of the grooves in the spool becomes aligned with one of the grooves in the bore, the fluid is immediately presented with a relatively large area for communication between the outer member and the spool. Thus a rush of fluid between the outer member and the spool may immediately occur. For some applications this proves to be disadvantageous. For example, when such spool valves are used for steering cylinders on inboard/outboard, outboard or inboard marine drives, this characteristic of typical spool valves presents problems. Some marine stem drives are prone to side to side movement and this characteristic is exacerbated by the use of such a spool valve which immediately applies full fluid pressure as one of the grooves in the spool becomes aligned with one of the grooves on the housing.

In one particular type of steering cylinder, the exterior of the cylinder acts as the spool for a spool valve. The housing extends about the exterior of the cylinder for relative axial movement between the housing and the exterior of the cylinder. In this case the size of the valve spool is effectively fixed and thus the volume of fluid which flows as the valve opens cannot be controlled by reducing the size of the valve spool.

Accordingly, it is an object of the invention to provide an improved spool valve where the flow of fluid through the valve is limited compared to a conventional spool valve having annular grooves on both the spool and the housing.

It is another object of the invention to provide an improved spool valve where the initial flow of fluid through the valve is reduced, when the valve initially opens, compared to the flow through the valve when the valve is fully opened.

Is a further object of the invention to provide an improved combination actuator and spool valve, where the actuator housing acts as the spool for the spool valve, and where the flow through the spool valve is controlled compared to a conventional spool valve having annular grooves on both the spool and the housing.

It is a still further object of the invention to provide an improved marine steering apparatus where drive induced oscillations are dampened compared to a similar unit using a conventional spool valve to control fluid flow to and from the steering cylinder, without the need for a centering spring, an external damper or chamfers on conventional spool grooves to create a leak path.

SUMMARY OF THE INVENTION

According to one aspect of the invention, there is provided a valve comprising a housing with an elongated bore having a longitudinal axis and a spool reciprocatingly mounted within the bore for relative movement of the housing along the spool parallel to the axis. The housing has a housing passageway and the spool has a spool passageway. The passageways align in at least one axial position of the spool along the bore, whereby fluids can pass between the spool and the housing. The passageway of one of the spool or the housing includes a first groove which extends parallel to the axis, but not completely, circumferentially about said one of the spool or the housing. The passageway of another of the spool or the housing includes a second groove which extends circumferentially about said another of the spool or the housing.

According to another aspect of the invention, there is provided a combination actuator and spool valve. The actuator has an actuator housing with an outer portion which forms a spool for the spool valve. The spool valve has a valve housing which is generally concentric with the actuator housing and extends about the actuator housing. The valve housing has an elongated bore with a longitudinal axis and the spool is reciprocatingly mounted within the bore for relative movement of the housing along the spool parallel to the axis. The valve housing has a housing passageway and the spool has a spool passageway. The passageways align in at least one axial position of the spool along the bore, whereby fluids can pass between the spool and the valve housing. The passageway of one of the spool or the valve housing includes a first groove which extends parallel to the axis, but not completely, circumferentially about said one of the spool or the valve housing. The passageway of another of the spool or the valve housing includes a second groove which extends circumferentially about said another of the spool or the valve housing.

According to a further aspect of the invention, there is provided a marine steering apparatus comprising a tiller connected to a combination actuator and spool valve mounted thereon. The spool valve has a valve housing which is generally concentric with the actuator housing and extends about the actuator housing. The valve housing has an elongated bore with a longitudinal axis and the spool is reciprocatingly mounted within the bore for relative movement of the housing along the spool parallel to the axis. The valve housing has a housing passageway and the spool has a spool passageway, the passageways align in at least one axial position of the spool along the bore, whereby fluids can pass between the spool and the valve housing. The passageway of one of the spool or the valve housing includes a first groove which extends parallel to the axis, but not completely, circumferentially about said one of the spool or the valve housing. The passageway of another of the spool or the valve housing includes a second groove which extends circumferentially about said another of the spool or the valve housing.

The invention offers significant advantages compared to the prior art. It allows the spool valve to be used in applications where a sudden flow of fluid, or a sudden cessation in the flow, as occurs when a conventional spool valve opens and closes, would be disadvantageous. In particular, the valve is advantageous for use on marine steering systems. It provides a combination steering actuator and spool valve connected to the tiller of the marine craft. Such a combination of an actuator and spool valve, according to the invention, effectively dampens drive oscillations without the necessity of centering springs, external dampers or chamfers on conventional annular spool grooves as required by some prior art systems. Thus the number of components is significantly reduced and the system is overall more economical and reliable.

DETAILED DESCRIPTION OF THE PREFERRED EMBODIMENTS

Figure 1:
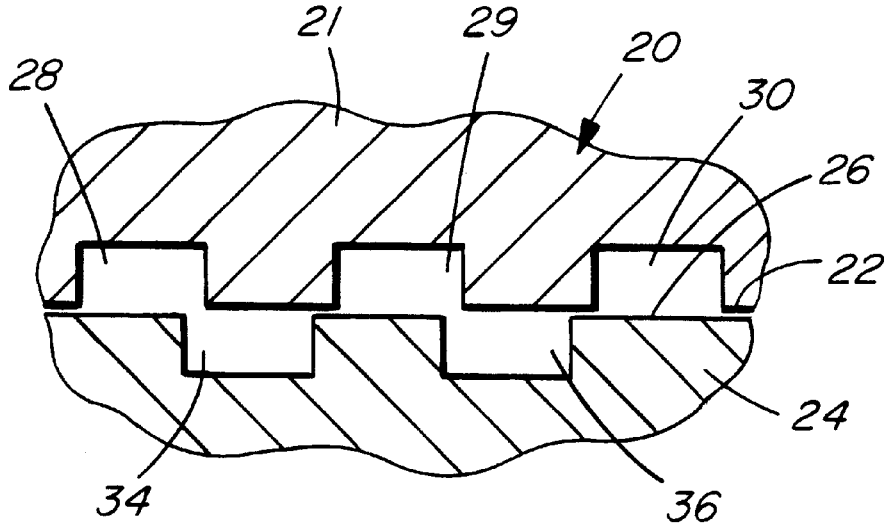
FIG. 1 PRIOR ART
FIG. 1 is a diagrammatic view showing the ports of a spool and valve housing for a typical spool valve according to the prior art.

Referring to the drawings, and first to FIG. 1, this shows a typical spool valve 20 according to the prior art. The valve has a housing 21 with cylindrical bore 22. There is a spool 24 having a cylindrical outer surface 26 which is reciprocatingly received in the bore. The housing in this example has three spaced-apart passageways 28, 29 and 30 which extend curcumferentially about the inside of the bore. The spool has two such spaced-apart passageways 34 and 36 which extend circumferentially about outer surface 26 of the spool. In other embodiments there could be different numbers of passageways on the housing and spool respectively, but at least one passageway on each. Fluid can pass between the housing and the spool when at least one of the passageways on the housing is aligned with one of the passageways on the spool. For example, in FIG. 1 passageway 28 of the housing is partly aligned with passageway 34 of the spool, permitting fluid to pass between the spool and the housing.

Figure 2:
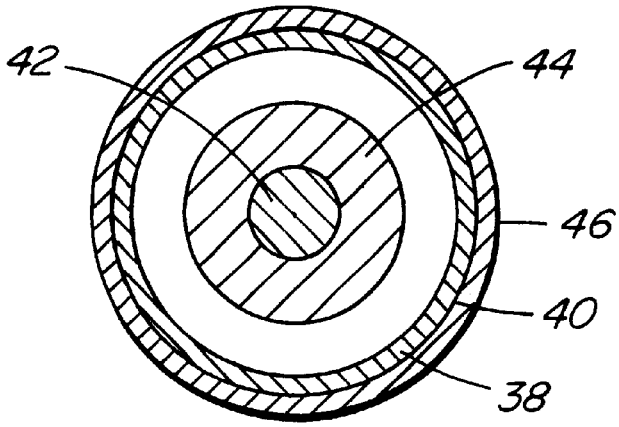
FIG. 2 PRIOR ART
FIG. 2 is a sectional view of a combination fluid actuator and spool valve according to the prior art.
Figure 3:
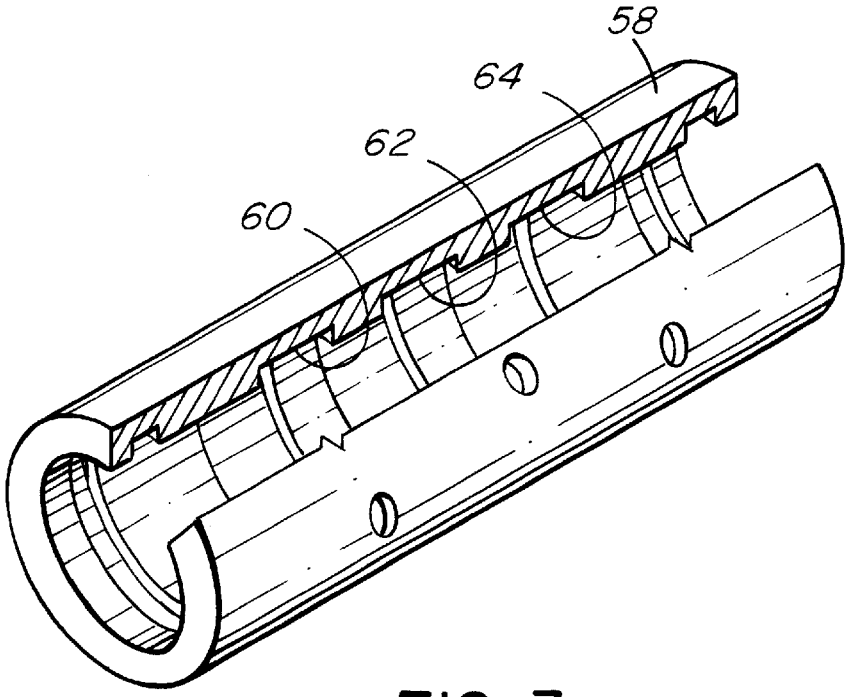
FIG. 3 is a perspective view, partly broken away, of a housing or sleeve for a combination spool valve and actuator according to an embodiment of the invention.

FIG. 2 illustrates a special type of spool valve also known in the prior art. In this example the spool is in the form a cylindrical fluid actuator 38 having a cylindrical outer surface 40 and an interior shaft 42 provided with a piston 44. The housing in this example is in the form of a sleeve 46 which extends about the spool formed by the fluid actuator 38. There is a problem however when both the outer surface 40 of the cylinder and the interior of sleeve 46 are provided with circumferential passageways as shown in the previous embodiment. When one of the passageways of the spool becomes aligned with one of the passageways of the housing, for example passageways 34 and 28 of the previous embodiment, a large uncontrolled flow of fluid occurs. For some applications, this presents difficulties. For example, such valves may be utilized on marine steering apparatuses, such as used for inboard/outboard drives, outboard drives or inboard drives. Inboard/outboard drives and outboard drives may have a tendency to move from side to side due to drive oscillations. The sudden flow of fluid as the passageways become aligned, may tend to cause the apparatus to become more unstable. This may also occur when the fluid flow is suddenly cut off as the passageways become unaligned when the spool is moved relative to the housing.

FIGS. 5–9 show a combination actuator and spool valve 50 according to an embodiment of the invention. Actuator 52 is a hydraulic cylinder in this example and is integrated with a bracket 54 connected to a cable tube mount 56, though this not essential to the invention. The cable tube 51 is reciprocatingly received in the mount for horizontal movement, from the point of view of FIG. 8. The housing of the valve is in the form of a sleeve 58 shown in better detail on FIGS. 3, 8, 13 and 14. In this example the sleeve has three interior circumferential, annular passageways 60, 62 and 64. In this example, the passageways 60 and 64 are connected to interior conduit 65, as seen in FIG. 14, which, in turn, is connected to fitting 67, shown in FIGS. 8 and 13, which is connected to a hydraulic fluid reservoir. Passageway 62 is connected through an interior passageway, not shown, to fitting 71 which is connected to a hydraulic pump or other source of pressurized hydraulic fluid. It should be understood that in other embodiments there could be a different number of passageways provided that both the spool and the housing have at least one passageway each. The sleeve in this example is connected to a bracket 59 which has a cable tube mount 61 which reciprocatingly receives the cable tube 51.

Figure 8:
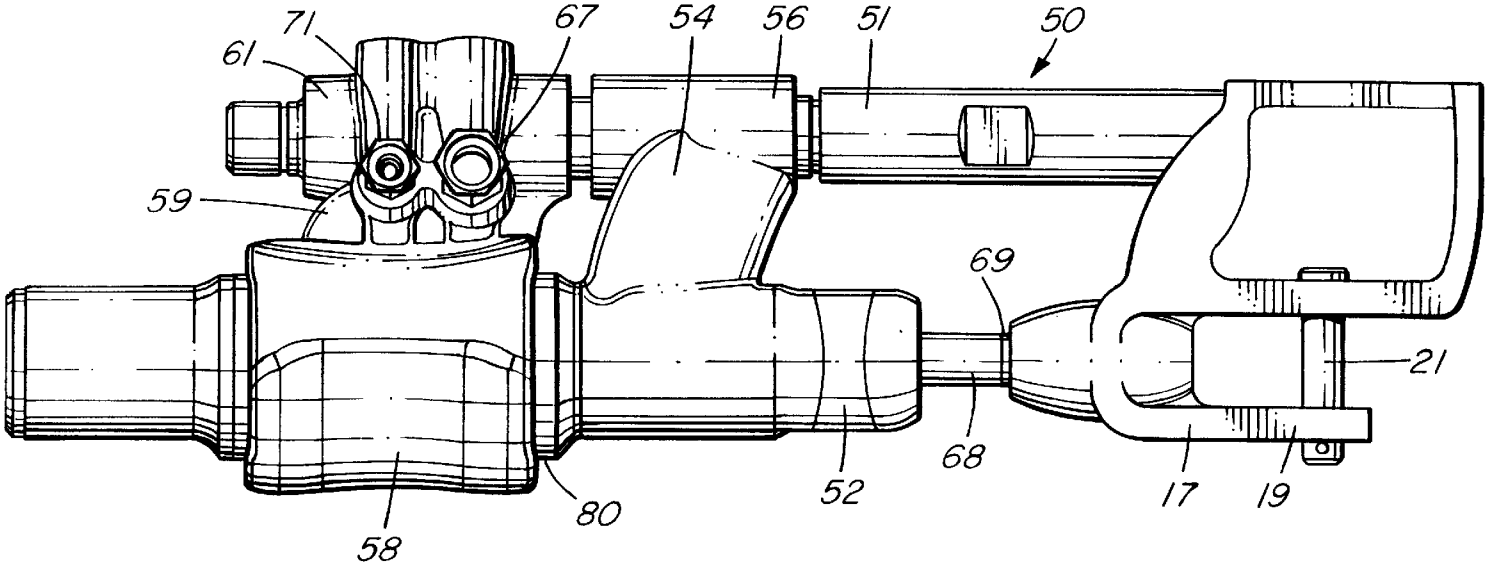
FIG. 8 is side view thereof.
Figure 9:
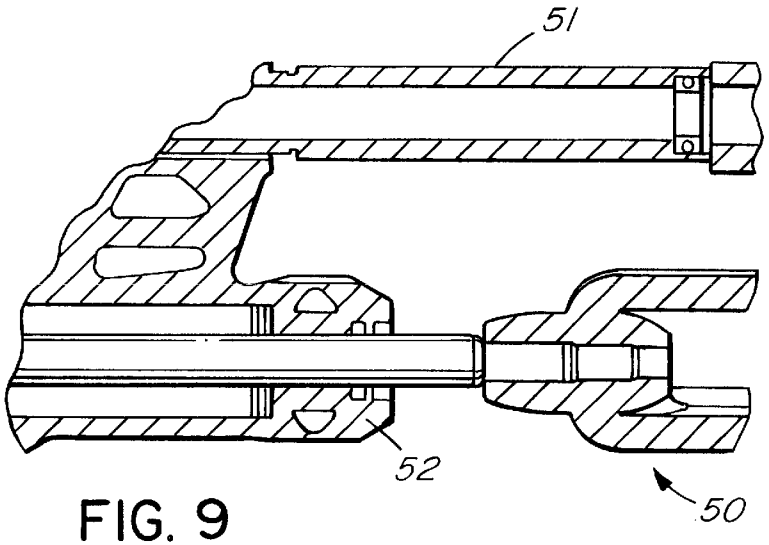
FIG. 9 is a fragmentary sectional view taken along line 9—9 of FIG. 6.
Figure 13:
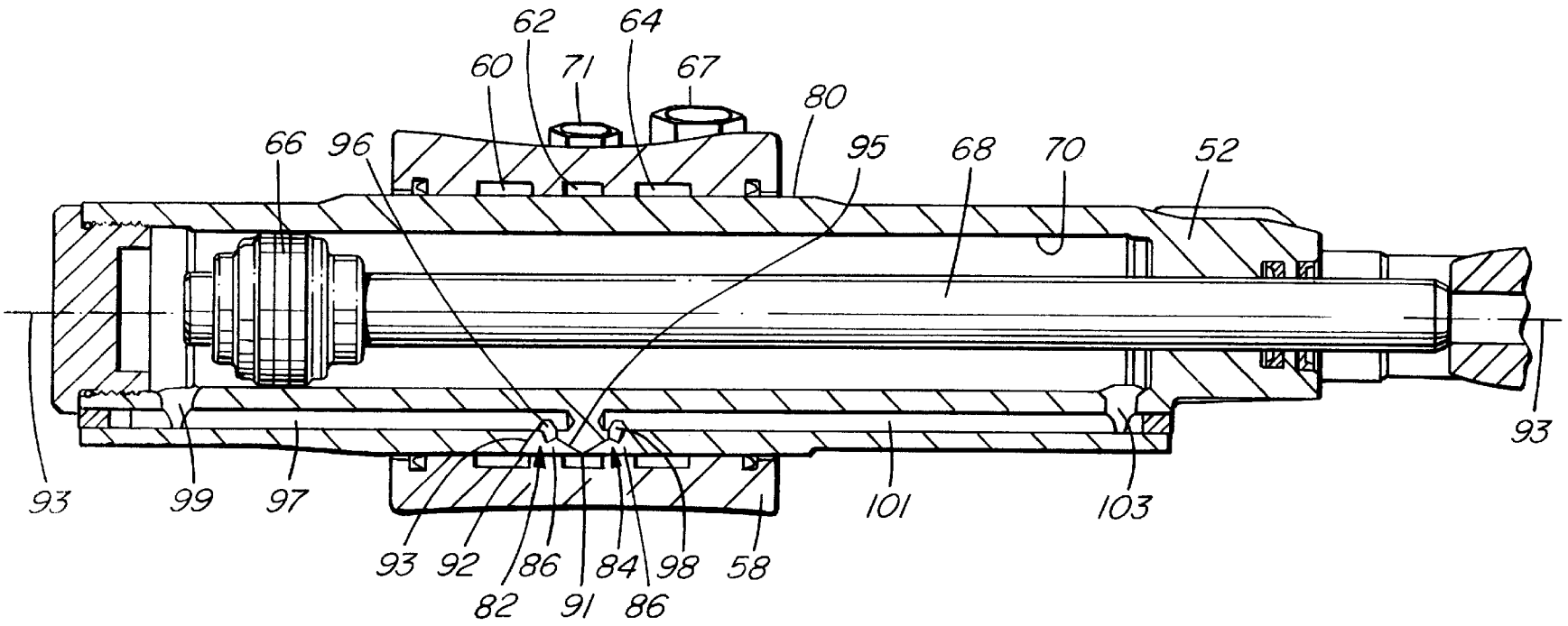
FIG. 13 is a longitudinal section of the actuator and spool valve.
Figure 14:
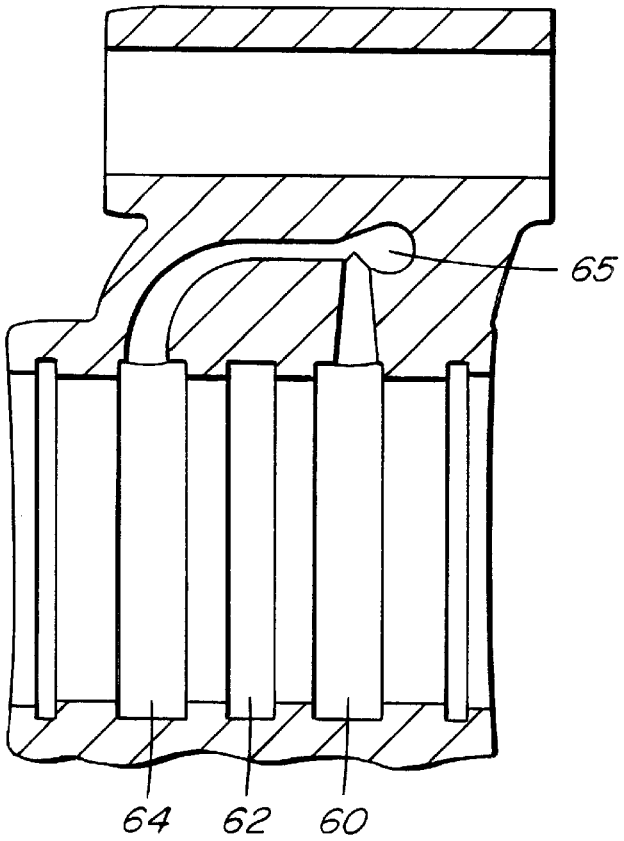
FIG. 14 is a fragmentary section of the housing.
Figure 15:
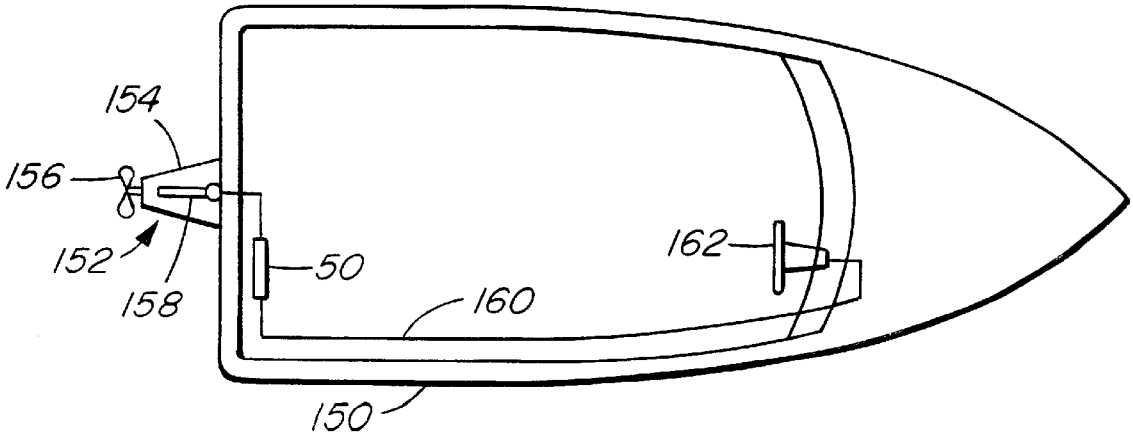
FIG. 15 is a simplified, top plan of a marine vessel fitted with the combination actuator and spool valve

As in the previous embodiment, the actuator 52 has a piston 66 mounted on a rod 68 as seen best in FIG. 13. The piston is slidingly received within bore 70 of the actuator. As seen in FIG. 8, exterior end 69 of the rod is connected to bracket 17. The steering cable 160, shown in FIG. 15, is fixedly connected to the bracket. The bracket includes an integral clevis 19 with a link pin 21 which is pivotally connected to tiller 158 shown in FIG. 15.

Figure 6:
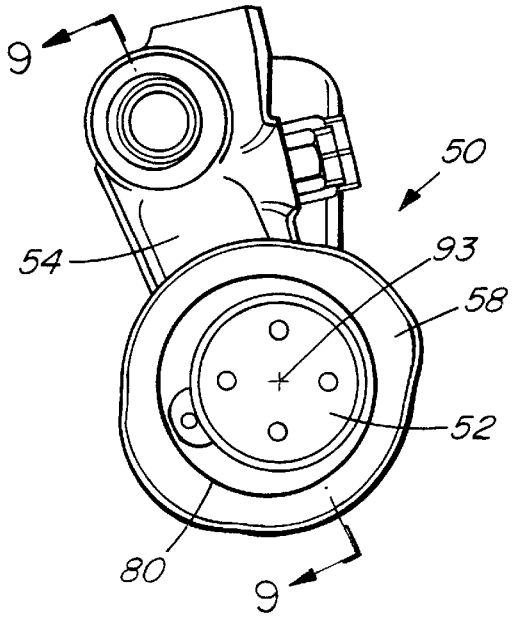
FIG. 6 is an end view of one end thereof.
Figure 7:
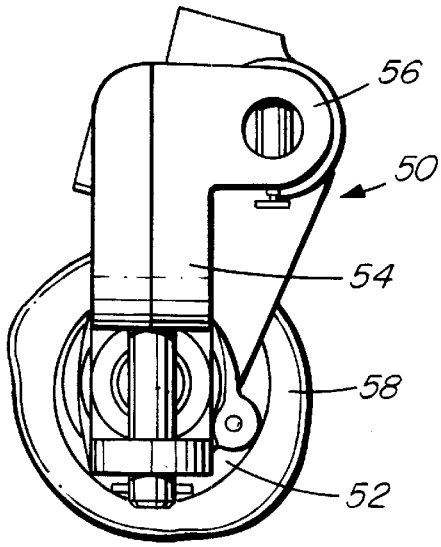
FIG. 7 is a an end view of the end opposite FIG. 6.

The spool valve 50 however varies from the prior art in the nature of the passageways on the spool formed by the actuator 52. The actuator has a cylindrical outer surface 80 which has two passageways 82 and 84, shown best in FIG. 10 which, unlike the prior art, do not extend completely circumferentially about the circumference of the outer surface 80. Instead, the passageways extend parallel to longitudinal, central axis 90 of the outer surface of the actuator. In both cases the circumference of the actuator, apart from the relatively small fraction of the circumference occupied by the groove, constitutes cylindrical surface 80 and is a land of the valve. In this example it should be noted that the cylinder bore 70 of the actuator has an axis 93, shown in FIG. 13, which is slightly eccentric with respect to axis 90, but this is not critical to the invention. FIG. 6 also shows the eccentric displacement of the outer surface 80 relative to axis 93. The passageways 82 and 84 extend parallel to either axis.

Figure 10:
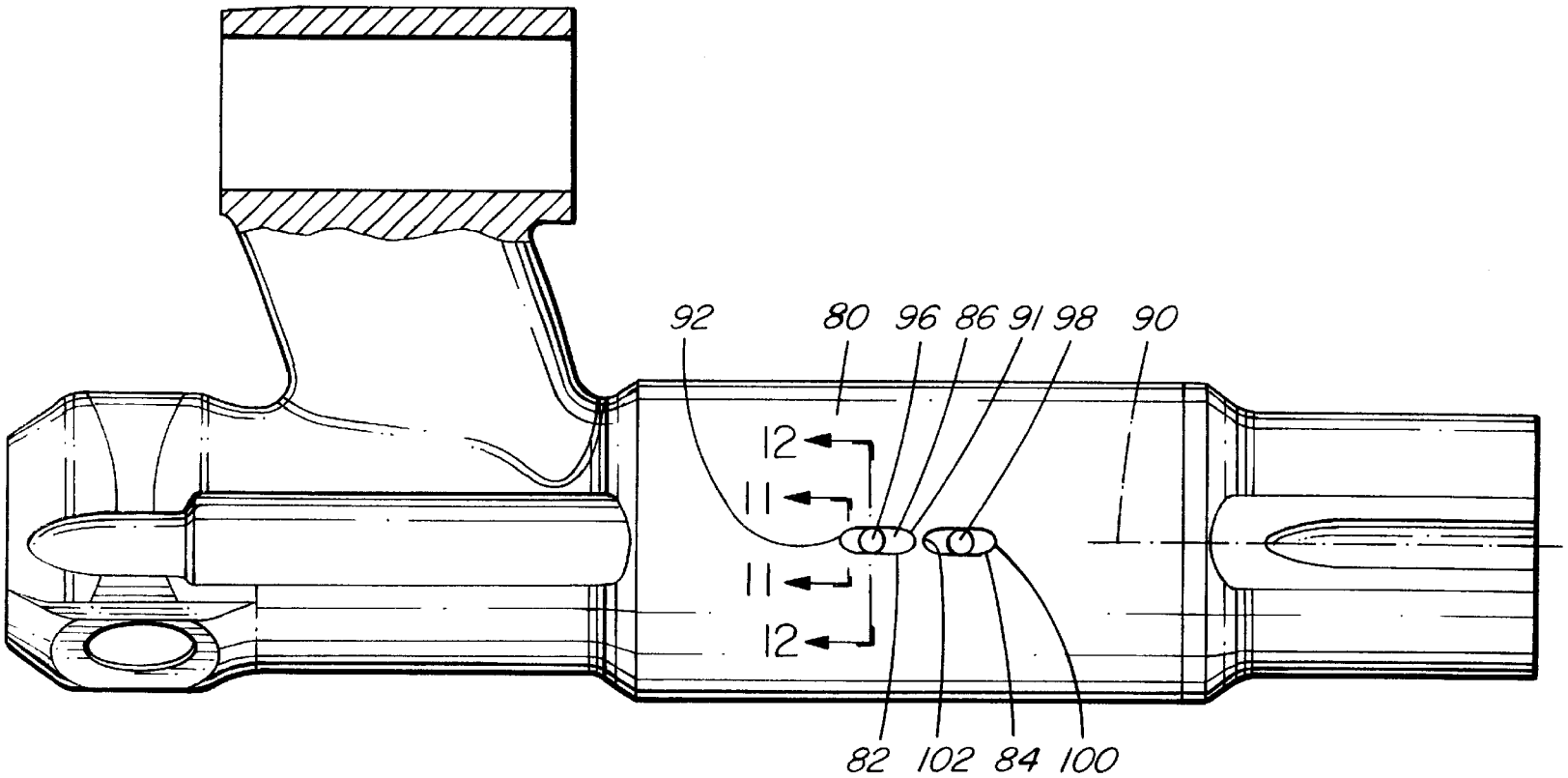
FIG. 10 is a side elevation, partly in section, of the combination actuator cylinder and school thereof
Figure 12:
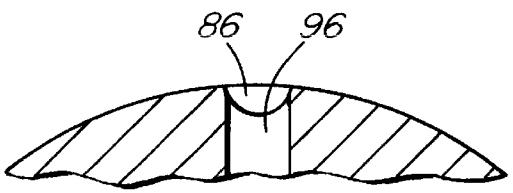
FIG. 12 is a fragmentary sectional view taken along line 12—12 of FIG. 10.
Figure 11:
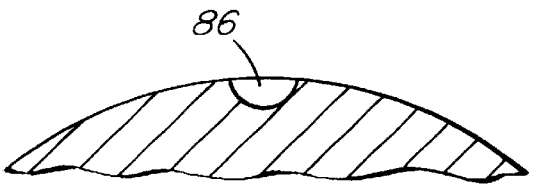
FIG. 11 is a fragmentary sectional view taken along line 11—11 of FIG. 10.

Referring to FIG. 10, it may be seen that each of the passageways includes a groove 86. Each groove has a first end 91 and a second end 92 which are spaced apart in a direction parallel to the axis 90. Each of the ends 91 and 92 is rounded in this example. The grooves do not extend completely through the spool, but are rather shallow depressions in the outer surface of the spool. This may be seen with reference to the sectional views of FIG. 11 and FIG. 12. The grooves are machined so they become shallower from the center of the groove, illustrated by FIG. 12, towards the ends of the grooves as indicated by FIG. 11. It may also be appreciated that the cross-section of the groove become smaller towards the ends as may be seen by comparing FIG. 12 and FIG. 11.

As may be seen in FIG. 10, each of the passageways 82 and 84 also includes an opening 96 which extends through the spool which comprises the actuator in this example. The opening communicates with the groove 86 and with bore 97 which extends longitudinally through the actuator and communicates with cylinder bore 70 through opening 99. In this particular example, the groove 86 is sloped more steeply along bottom surface 93, which is inclined towards end 92, compared with bottom surface 95 which is inclined towards end 91. In other embodiments, however, the configuration of the groove may vary. In other examples, the slopes of surfaces 93 and 95 are equal. It should also be understood that in alternative embodiments passageways 82 and 84, which extend axially with respect to the axis 90, may be in the housing, while the spool could have conventional circumferential passageways such as passageways 60, 62 and 64. In this example, which is configured for use on the stern drive unit of a marine craft, passageways 60 and 64 are connected to tank for a return flow of fluid, while passageway 62 is connected to a hydraulic pump which supplies hydraulic fluid to the actuator as discussed above. Passageway 84 is connected to the opposite end of the actuator compared with passageway 82, via opening 98, bore 101 and opening 103 and thus the spool valve is used to direct pressurized hydraulic fluid to the appropriate end of the actuator depending upon the direction in which the marine craft is being steered. In alternative examples the openings 96 and 98 and bores 97 and 101 could be replaced with other openings communicating with the groove and alternative hydraulic fluid passageways.

In operation, the spool valve 50 is similar to prior art spool valves. When the passageways 82 and 84 in the spool become aligned with the passageways 60, 62 and 64 in the housing, fluid flow is permitted between the housing and the spool. However, the restricted size and axial elongation of the passageways controls the flow of fluid more restrictively compared with a conventional spool valve. For example, when passageway or port 82 of the spool approaches passageway or port 60 of the housing, the first thing that occurs is that end 91 of groove 86 impinges on the passageway 90 and thus permits only a relatively restrictive flow fluid between the spool and the housing. This is due to the shallow nature of the groove adjacent end 91. This flow increases as the groove 86 and bore 96 move more fully into communication with the passageway 60. Likewise, in the reverse direction, when the passageway 82 moves away from passageway 60, the flow fluid gradually tapers off.

Figure 4:
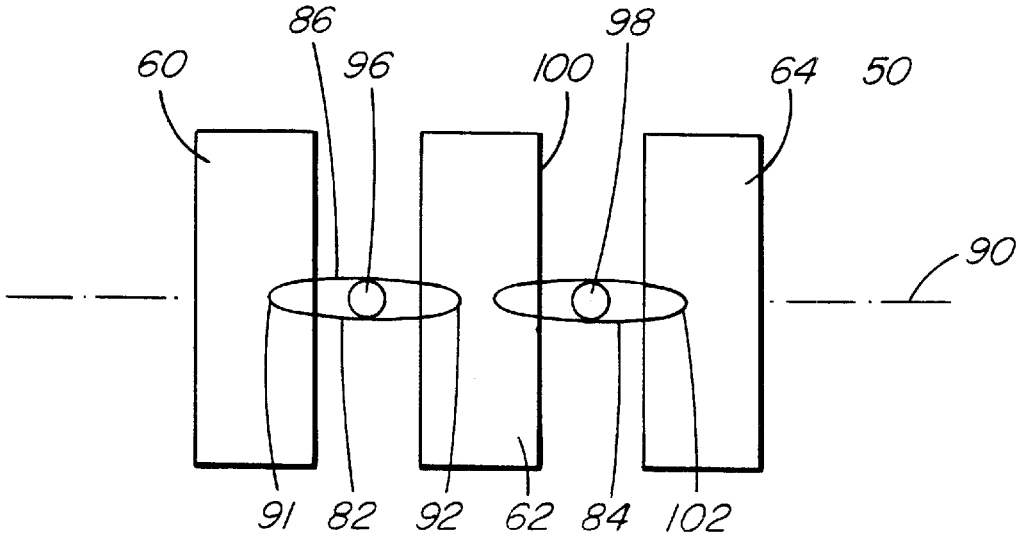
FIG. 4 is diagrammatic illustration of the ports thereof.
Figure 5:
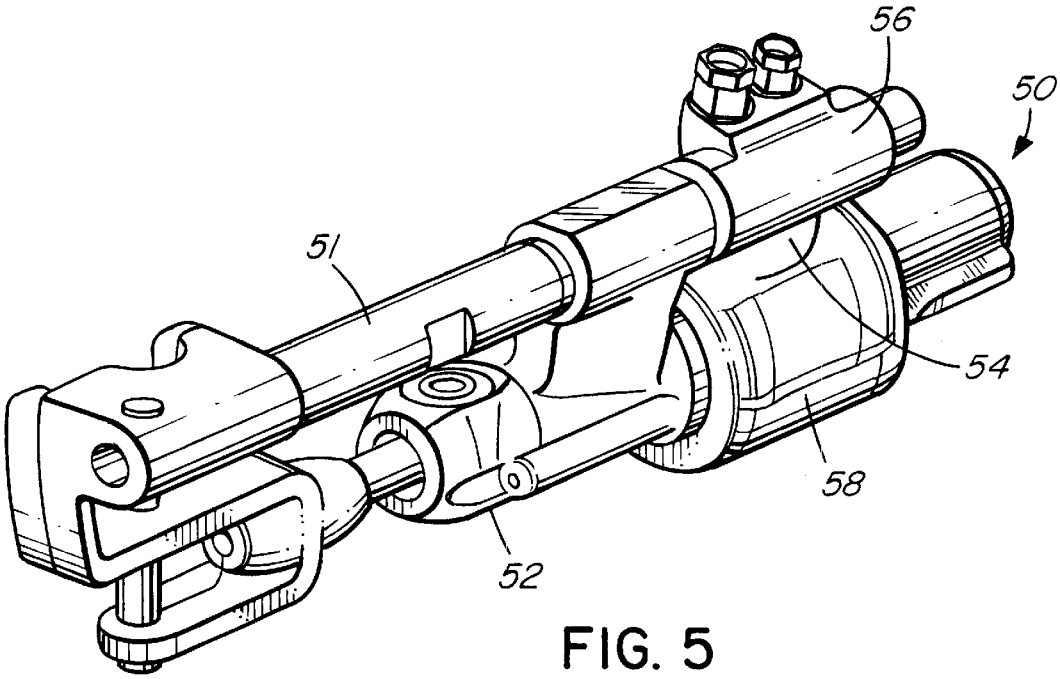
FIG. 5 is an isometric view of the combination spool valve and actuator according to the embodiment of the invention of FIGS. 3 and 4.

FIG. 15 shows a marine vessel 150 equipped with an inboard/outboard drive unit 152 including a leg 154 and a propeller 156. The inboard/outboard drive has a tiller 158 which is connected to a combination actuator and spool valve 50 as described in detail above. Cable 160 connects the combination actuator and spool valve with helm 162 of the craft. This is a typical installation of the combination actuator and spool valve although, as disclosed above, it could be fitted to other marine craft including craft with outboard drives and with inboard drives. Also, alternatively, the helm could include a fluid pump and the cable would be replaced by fluid lines. In this example, the end of cable 160 adjacent the stem of the vessel is connected to cable tube 51 and causes the tube bracket 17 and rod 68 to move to the right or to the left, from the point of view of FIG. 8. when the helm is steered in one direction on the other. For example, when the helm is steered in one direction, this causes the rod 68 to move to the right from the point of view of FIG. 8 and FIG. 13. This tends to move the bracket 17 to the right, but does not have sufficient force to do so. Instead, since the outer casing of the cable is connected to cable to mount 61, housing 58 moves in the opposite direction, that is to the left, relative to surface 80. The housing moves and stays in the generally left position long as the wheel continues turning. This causes passageway 62 on the housing to align with passageway 82 on the spool so pressurized hydraulic fluid flow through opening bore 97, and passageway 99 to the left end of the cylinder. This forces the piston 66 to the right, thus moving the bracket 17, the pin 21 and the tiller 158, shown in FIG. 15, to the right from the point of view of FIG. 8. When movement of the wheel is stopped, the housing 58 moves to the right relative to surface 80, due to frictional effects, to return to the position of FIG. 13. In this position, equivalent to the position of FIG. 4, all of the pressurized hydraulic fluid entering through passageway 62 on the housing 58 passes directly through passageways 82 and 84 and passageways 60 and 64 and returns to the reservoir or tank. Thus there is no steering effect.

It will be understood by someone skilled in the art that many of the details provided above are by way of example only and are not intended to limit the scope of the invention as defined in the following claims.

What is claimed is:

1. A combination actuator and spool valve, the actuator being a fluid actuator and having an actuator housing with an internal bore and an outer portion which forms a spool for the spool valve, and a piston reciprocatingly received in the bore, the spool valve having a valve housing which is generally concentric with the actuator housing and extends about the actuator housing, the valve housing having an elongated bore with a longitudinal axis, the spool being reciprocatingly mounted within the elongated bore for relative movement of the value housing along the spool parallel to the axis, the valve housing having a housing passageway and the spool having a spool passageway, the passageways aligning in at least one axial position of the spool along the eloganted bore, whereby fluids can pass between the spool and the valve housing, the passageway of one of the spool or the valve housing including a first groove which extends parallel to the axis, but not completely, circumferentially about said one of the spool or the valve housing, the passageway of another of the spool or the valve housing including a second groove which extends circumferentially about said another of the spool or the valve housing.

2. The combination as claimed in claim 1, wherein the first groove is longer in a direction parallel to the axis than in a direction circumferentially about said one of the spool or the valve housing.

3. The combination as claimed in claim 1, wherein the second groove is annular.

4. The combination as claimed in claim 1, wherein the first groove has first and second ends which are spaced apart in the direction parallel to the axis, the groove having a cross-sectional area which decreases towards the ends.

5. The combination as claimed in claim 4, wherein the passageway of the said one of the spool or the valve housing includes an opening extending through said one of the spool or the housing and communicating with the first groove.

6. The combination as claimed in claim 5, wherein the first groove has a bottom which slopes more steeply towards the first end than the second end.

7. The combination as claimed in claim 6, wherein said one of the valve housing or the spool has a third groove substantially the same as the first groove and spaced-apart therefrom.

8. The combination as claimed in claim 7, wherein said another of the valve housing or the spool has fourth and fifth grooves which are substantially the same as the second groove and are spaced-apart therefrom and from each other.

9. The combination as claimed in claim 8, wherein the first and third grooves are in the spool and the second, fourth and fifth grooves are in valve housing.

10. The combination as claimed in claim 1, wherein the first groove is a shallow depression in said one of the spool or the housing.

11. A marine steering apparatus comprising a tiller connected to a combination fluid actuator and spool valve mounted thereon, the actuator having an actuator housing with an internal cylinder bore and an outer portion which forms a spool for the spool valve, and a piston reciprocatingly received in the bore, the spool valve having a valve housing which is generally concentric with the actuator housing and extends about the actuator housing, the valve housing having an elongated bore with a longitudinal axis, the spool being reciprocatingly mounted within the elongated bore for relative movement of the valve housing along the spool parallel to the axis, the valve housing having a housing passageway and the spool having a spool passageway, the passageways aligning in at least one axial position of the spool along the elongated bore, whereby fluids can pass between the spool and the valve housing, the passageway of one of the spool or the valve housing including a first groove which extends parallel to the axis, but not completely, circumferentially about said one of the spool or the valve housing, the passageway of another of the spool or the valve housing including a second groove which extends circumferentially about said another of the spool or the valve housing.

12. The apparatus as claimed in claim 11, wherein the first groove is longer in a direction parallel to the axis than in a direction circumferentially about said one of the spool or the valve housing.

13. The apparatus as claimed in claim 11, wherein the second groove is annular.

14. The apparatus as claimed in claim 11, wherein the first groove has first and second ends which are spaced-apart in the direction parallel to the axis, the groove having a cross-sectional area which decreases towards the ends.

15. The apparatus as claimed in claim 14, wherein the passageway of the said one of the spool or the valve housing including an opening extending through said one of the spool or the housing and communicating with the first groove.

16. The apparatus as claimed in claim 15, wherein the first groove has a bottom which slopes more steeply towards the first end than the second end.

17. The apparatus as claimed in claim 16, wherein said one of the valve housing or the spool has a third groove substantially the same as the first groove and spaced-apart therefrom.

18. The apparatus as claimed in claim 17, wherein said another of the valve housing or the spool has fourth and fifth grooves which are substantially the same as the second groove and are spaced-apart therefrom and from each other.

19. The apparatus as claimed in claim 18, wherein the first and third grooves are in the spool and the second, fourth and fifth grooves are in valve housing.

20. The apparatus as claimed in claims 11, wherein the first groove is a shallow depression in said one of the spool or the housing.

* * * * *